United States Patent [19]

Andorsen et al.

[11] 4,033,596

[45] July 5, 1977

[54] ROLLER SKI HAVING LEG OPERATED BRAKING MEANS

[76] Inventors: John Peter Andorsen, Dalgardstien 5, 7000 Trondheim; Helge Revhaug, Saupstadringen 43A, 7078 Saupstad; Ole Nyberg, Osloveien 30, 7000 Trondheim, all of Norway

[22] Filed: Aug. 25, 1975

[21] Appl. No.: 607,671

[52] U.S. Cl. ..... 280/11.2

[51] Int. Cl.[2] ..... A63C 17/14

[58] Field of Search ..... 280/11.2, 11.1 BT, 11.19, 280/11.36

[56] References Cited

UNITED STATES PATENTS

| | | | |
|---|---|---|---|
| 926,646 | 6/1909 | Eubank, Jr. | 280/11.2 |
| 1,402,010 | 1/1922 | Ormiston | 280/11.2 X |
| 1,687,739 | 10/1928 | Slusher | 280/11.2 |
| 1,854,188 | 4/1932 | Gregory | 280/11.19 |
| 2,179,592 | 11/1939 | Goettie | 280/11.2 |
| 3,767,220 | 10/1973 | Peterson | 280/11.36 X |

FOREIGN PATENTS OR APPLICATIONS

| | | | |
|---|---|---|---|
| 857,006 | 11/1952 | Germany | 280/11.36 |

*Primary Examiner*—Joseph F. Peters, Jr.
*Assistant Examiner*—Milton L. Smith

[57] ABSTRACT

Roller footwear devices, such as roller skis and roller skates, having sets of wheels on spaced apart parallel axles mounted on a web supporting foot-fastening means as well as brake means arranged to act on at least one of the wheels. A brake-actuating means is operatively associated with the brake means via intermediate actuation means so arranged as to cause the brake-actuating means to activate the brake means by action from the leg or knee region on moving the latter substantially at right angles to the axles of the wheels starting from a position adopted by this region during normal operation of the device.

5 Claims, 4 Drawing Figures

ROLLER SKI HAVING LEG OPERATED BRAKING MEANS

BACKGROUND OF INVENTION

1. Field of Invention

This invention relates to roller footwear devices, such as roller skis and roller skates.

2. Description of the Prior Art

In road traffic on roller skis and roller skates, it is desirable to be able to effect controlled braking, primarily in order to avert mishaps, such as collisions, running down pedestrians and driving off the established roadway. This applies especially to road traffic in undulating terrain. Different arrangements are known for braking roller skis involving, for example, brake-actuating by hand or with a ski pole. Common to this type of braking arrangement is that a certain time is required to effect braking. The brake-actuating with a ski pole is, moreover, difficult to carry out especially in a critical situation where rapid braking is necessary. A common disadvantage with these braking arrangements is that they place a restriction on the movement of at least one arm which ought to be free so that the skier can preserve his or her balance.

Braking arrangements are also known based on application by the skier's heel, for example, by twisting to the side relative to the normal position. However, the freedom of movement is small for this portion of the body and it can be reduced still further in an awkward situation where rapid braking is essential.

SUMMARY OF THE INVENTION

The main object of the invention is, therefore, to provide roller skis embodying brake means not burdened with the aforesaid disadvantages and which, in addition, are light in weight and simple to manufacture. Moreover, the brake means must occupy little space so as not to create problems in the transportation and storage of the device.

According to the present invention a roller ski comprises a web; axles mounted in parallel on said web adjacent front and rear ends of the latter; two sets of wheels mounted for rotation each on a respective one of said axles of which at least the rearmost set has two wheels, the distance between said axles being a multiple of the diameter of the wheels; a binding for the foot of the skier mounted on said web between said sets of wheels enabling the sole of the foot to be positioned approximately at the level of said axles; a main U-shaped member comprising two arms joined by a bight at their upper ends while their lower free ends are pivotably mounted on said web permitting said member, when not in use, to be swung forwards from a substantially upstanding position in the direction of motion of said ski and downwards against said web with an arm disposed on each longitudinal side of the latter and, when in use, to be swung from said substantially upstanding position in the opposite direction as a result of the pressure exerted by the leg of the skier on being moved rearwardly into abutment with said bight; and brake means comprising an auxiliary U-shaped member comprising two arms joined by a bight at their upper ends while their lower, free ends are pivotably mounted on said web adjacent said rearmost set of wheels, said member being spring-loadedly urged forwardly and away from said wheels and positioned in the rearward path of movement of the main U-shaped member so as to be abuttably swingable rearwardly thereby against the spring loading to make braking contact with said rearmost set of wheels.

It has now been recognised that the leg region (regio cruris) or knee region (regio genu) of the human body can be moved relatively freely about the ankle joint, not only in the sagittal plane but also in the transverse plane. In the sagittal plane, the leg has a sector of movement of about ninety degrees. Under normal circumstances, on roller skis, there is a sector of leg movement of about 30° of the rearmost portion of its swing which is not utilised. This movement possibility and partially also the transverse movement can be employed for actuating the main U-shaped member.

It is especially advantageous to arrange the brake-actuating means so that on activation, it is moved against the direction the roller ski, for example, is moved in. In this way, there is utilised a relatively large free area of movement on moving the leg to the rear.

BRIEF DESCRIPTION OF THE DRAWINGS

In order that the invention can be more readily understood, convenient embodiments thereof will now be described, by way of example, with reference to the accompanying drawings in which.

DESCRIPTION OF CONVENIENT EMBODIMENTS

Figure 1:
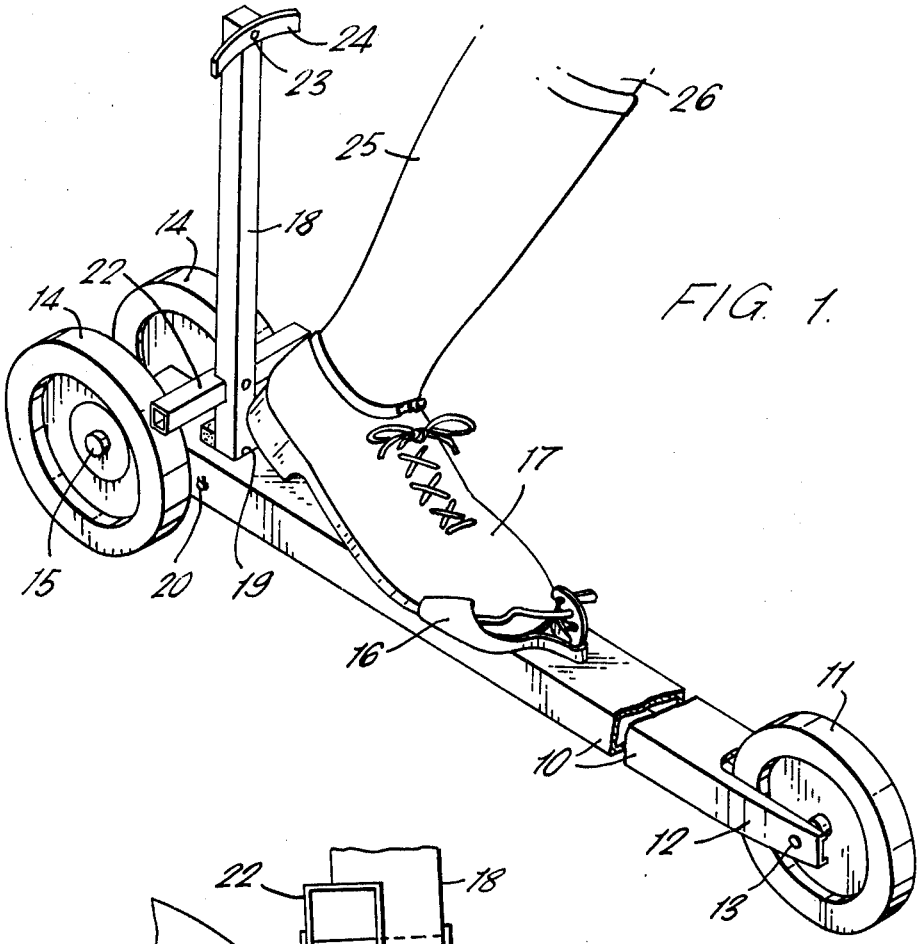
FIG. 1 is a perspective view of a roller ski according to a first embodiment, having two rear wheels and one at the front and showing the skier's leg in the operative position.

The invention is described below in connection with a single roller ski. It should be clear that roller skis are produced and used in pairs with most parts alike, while some parts can be designed or disposed symmetrically relative to the sagittal plane of the skier. In the figures, two right skis are illustrated but it should be apparent from this that what is shown applies equally well to left skis.

Referring to FIGS. 1–4, there is illustrated a ski with a support or web 10 in the form of a beam of hollow, aluminum profile of rectangular cross-section, in which a single front wheel 11 is located between fork ends 12 by means of an axle 13 while two rear wheels 14 are located one on each side of the web 10 on an axle 15 which extends parallel to the axle 13. The wheels 11 and 14 can be of conventional design, for example, having a free wheel hub, a rim and a rubber track. On the web 10, there is secured a binding 16 for the skier's shoes 17 (FIG. 1), in this instance a right binding.

Figure 2:
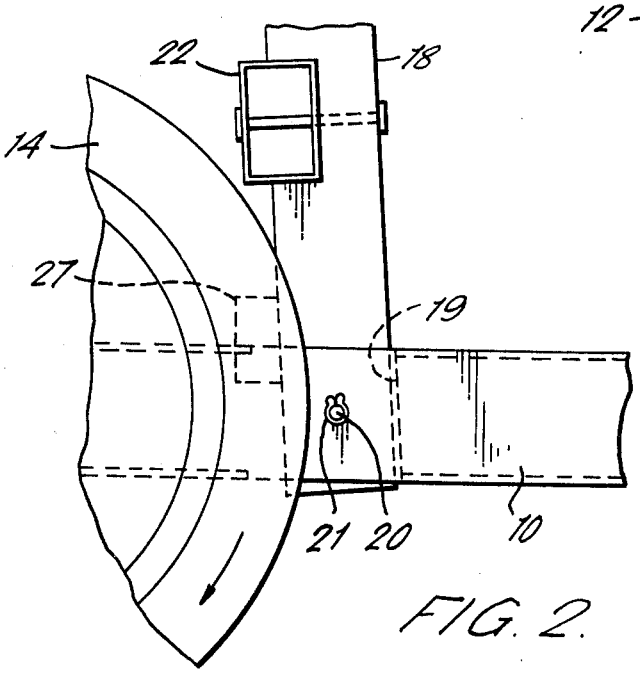
FIG. 2 is a vertical section on an enlarged scale through a portion of the roller ski of FIG. 1 and showing the brake means activated.

In FIGS. 1 and 2, there is illustrated a first embodiment in which there is mounted in an opening 19 in the web 10 and just in front of the rear wheels 14, an upwardly projecting rod 18 of hollow profile. The mounting is effected by way of an axle 20 which is led through the web 10 approximately parallel to the axle 15 and held secure by a safety ring 21 (FIG. 2) on each end of the axle projecting outside the web 10. The rod 18 supports two arms 22 which, for example, can be permanently welded and which project outwards on opposite sides of the rod radially outside the track of their respective one of the two rear wheels 15. Arms 22 which constitute the brake means are formed from a material which is sufficiently resistant to wear and provides sufficient friction to give a satisfactory braking effect. Alternatively the arms can be replaceable or can be provided with an exchangeable friction coating (not shown).

At the upper, free end of the rod 18, there is secured with a screw 23, a brake-actuating means in the form of a transverse rail 24 at the height of the rear side of the skier's leg 25 (regio cruris anterior). Preferably, it is positioned behind the most powerful muscular region of the leg but it can also lie behind the knee region of the skier (regio genu anterior) 26 or behind the lower part of the leg 25.

The forward movement of the rod 18 is limited by the edge of the opening 19 in the web 10. In order to lead it back to the rest position after activation and retain it in abutment with this edge, there is introduced on the opposite side of the opening 19 a block 27 of rubber or another elastically deformable material. In the rest position, the rod 18 forms an angle of at least ninety degrees with the front-lying portion of the web 10. In a modification of this embodiment, the rod can be dividable in order to simplify transportation of the roller ski.

Figure 3:
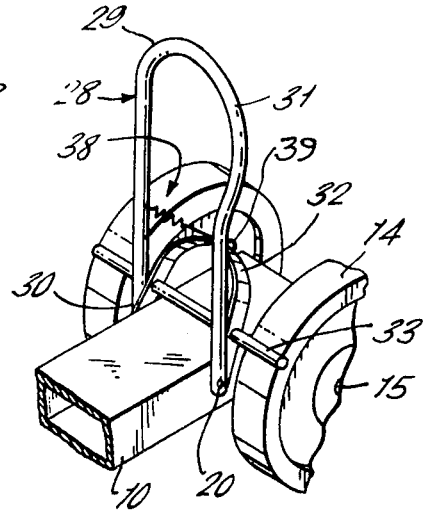
FIG. 3 is a perspective view of a portion of a roller ski according to a second embodiment.
Figure 4:
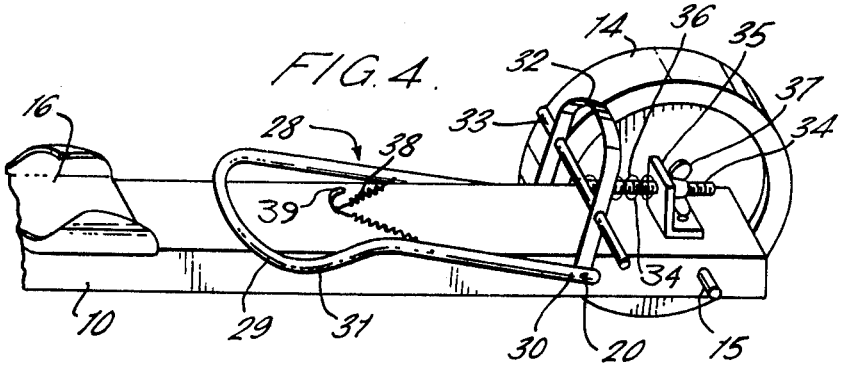
FIG. 4 is a perspective view, on a larger scale, of a section of the roller ski of FIG. 3 with the brake-actuating strap in the transportation position.

In FIGS. 3 and 4, there is illustrated a second embodiment in which the rod 18 and the rail 24 of the first embodiment described above are replaced by an approximately U-shaped strap 28 which is disposed with its bright 29 directed upwards relative to the web 10 and with ends 30 secured to the shaft 20 externally on the web 10. At the inner side relative to the skier, the uppermost portion of the strap 28 is curved somewhat outwards as shown at 31. The purpose of this curve 31 is to provide a larger extension to the breadth of the bright so as to provide for the possibility of brake-actuation over a larger area of movement in a transverse direction.

Together with the strap 28, referred to below as the brake-actuating strap, there are mounted on the shaft 20, the free ends of a second approximately U-shaped strap 32 which is substantially shorter than the brake-actuating strap 28 and which is positioned with its bright directed up between the brake-actuating strap 28 and the rear wheels 14. Strap 32, which is referred to below as the brake strap, carries a crosswise-extending bolt 33, the outwardly projecting ends of which serve as brake means and the central portion of which serves as an anchor for a stop screw 34 which extends rearwardly therefrom to and through a permanent bracket 35 fixed to the upper side of the web 10. The screw 34 carries a screw spring 36 which acts between the bracket 35 and the bolt 33 and pushes the brake strap forwards and away from the rear wheels as for the screw 34 permits. This force can be regulated by a wing nut 37 on the screw 34. The brake-actuating strap 28 is freely mounted relative to the brake strap 32 but its legs will thrust against the bolt 33 externally of the brake strap, that is on the outwardly projecting ends thereof. The brake-actuating strap 28 can be secured in this abutment position (FIG. 3) by way of a detachable clamp spring 38 which is mounted with one leg to a corresponding one of the legs of the brake-actuating strap 28 and which is provided with a hook 39 which can be led down behind the bright on the brake strap 32. When it is released from the brake strap 32, the brake-actuating strap 28 can be pivoted down towards the web 10 as shown in FIG. 4.

In a modification of the embodiment of FIGS. 3 and 4, the free ends of the approximately U-shaped strap 28 are mounted on the shaft 20 within the free ends of the approximately U-shaped brake strap and braking is effected when lower portions of the arms of strap 28 bear directly against the bright of the brake strap causing curved end portions of said bright to bear against the rear wheels 14. It is also possible to allow the brake means to act on a disc which is connected to a rear wheel so as to rotate therewith.

We claim:

1. Roller ski which comprises a web; axles mounted in parallel on said web adjacent front and rear ends of the latter; two sets of wheels mounted for rotation each on a respective one of said axles of which at least the rearmost set has two wheels, the distance between said axles being a multiple of the diameter of the wheels; a binding for the foot of the skier mounted on said web between said sets of wheels enabling the sole of the foot to be positioned approximately at the level of said axles; a main U-shaped member comprising two arms joined by a bight at their upper ends while their lower free ends are pivotably mounted on said web permitting said member, when not in use, to be swung forwards from a substantially upstanding position in the direction of motion of said ski and downwards against said web with an arm disposed on each longitudinal side of the latter and, when in use, to be swung from said substantially upstanding position in the opposite direction as a result of the pressure exerted by the leg of the skier on being moved rearwardly into abutment with said bight; and brake means comprising an auxiliary U-shaped member comprising two arms joined by a bight at their upper ends while their lower, free ends are pivotably mounted on said web adjacent said rearmost set of wheels, said member being spring-loadedly urged forwardly and away from said wheels and positioned in the rearward path of movement of the main U-shaped member so as to be abuttably swingable rearwardly thereby against the spring loading to make braking contact with said rearmost set of wheels.

2. Roller ski which comprises a web; axles mounted in parallel on said web adjacent front and rear ends of the latter; two sets of wheels mounted for rotation each on a respective one of said axles of which at least the rearmost set has two wheels, the distance between said axles being a multiple of the diameter of the wheels; a binding for the foot of the skier mounted on said web between said sets of wheels enabling the sole of the foot to be positioned approximately at the level of said axles; a main U-shaped member comprising two arms joined by a bight at their upper ends while their lower free ends are pivotably mounted on said web permitting said member, when not in use, to be swung forwards from a substantially upstanding position in the direction of motion of said ski and downwards against said web with an arm disposed on each longitudinal side of the latter and, when in use, to be swung from said substantially upstanding position in the opposite direction as a result of the pressure exerted by the leg of the skier on being moved rearwardly into abutment with said bight; and brake means comprising an auxiliary U-shaped member comprising two arms joined by a bight at their upper ends while their lower, free ends are pivotably mounted on said web adjacent said rearmost set of wheels, said member being spring-loadedly urged forwardly and away from said wheels and positioned in the rearward path of movement of the main U-shaped member so as to be abuttably swingable rearwardly thereby against the spring loading, said free ends of said main U-shaped member being mounted outside said free ends of said auxiliary U-shaped member on a common shaft and at least one of the arms of the auxiliary U-shaped member having a brake element projecting outwardly therefrom parallel to the axle of the rearmost set of wheels, said element being adapted to brakingly abut one of the two wheels of said rearmost set on rearwardly swinging said auxiliary U-shaped member.

3. Roller ski which comprises a web; axles mounted in parallel on said web adjacent front and rear ends of the latter; two sets of wheels mounted for rotation each on a respective one of said axles of which at least the rearmost set has two wheels, the distance between said axles being a multiple of the diameter of the wheels; a binding for the foot of the skier mounted on said web between said sets of wheels enabling the sole of the foot to be positioned approximately at the level of said axles; a main U-shaped member comprising two arms joined by a bight at their upper ends while their lower free ends are pivotably mounted on said web permitting said member, when not in use, to be swung forwards from a substantially upstanding position in the direction of motion of said ski and downwards against said web with an arm disposed on each longitudinal side of the latter and, when in use, to be swung from said substantially upstanding position in the opposite direction as a result of the pressure exerted by the leg of the skier on being moved rearwardly into abutment with said bight; and brake means comprising an auxiliary U-shaped member comprising two arms joined by a bight at their upper ends while their lower, free ends are pivotably mounted on said web adjacent said rearmost set of wheels, said member being spring-loadedly urged forwardly and away from said wheels and positioned in the rearward path of movement of the main U-shaped member so as to be abuttably swingable rearwardly thereby against the spring loading, said free ends of said main U-shaped member being mounted outside said free ends of said auxiliary U-shaped member on a common shaft; and a continuous bar arranged parallel to the axle of the rearmost set of wheels and passing through the arms of the auxiliary U-shaped member to form end portions projecting outwardly from said member, each end portion of said bar being adapted to brakingly abut a respective one of the two wheels of said rearmost set on rearwardly swinging said auxiliary U-shaped member.

4. Roller ski which comprises a web; axles mounted in parallel on said web adjacent front and rear ends of the latter; two sets of wheels mounted for rotation each on a respective one of said axles of which at least the rearmost set has two wheels, the distance between said axles being a multiple of the diameter of the wheels; a binding for the foot of the skier mounted on said web between said sets of wheels enabling the sole of the foot to be positioned approximately at the level of said axles; a main U-shaped member comprising two arms joined by a bight at their upper ends while their lower free ends are pivotably mounted on said web permitting said member, when not in use, to be swung forwards from a substantially upstanding position in the direction of motion of said ski and downwards against said web with an arm disposed on each longitudinal side of the latter and, when in use, to be swung from said substantially upstanding position in the opposite direction as a result of the pressure exerted by the leg of the skier on being moved rearwardly into abutment with said bight; and brake means comprising an auxiliary U-shaped member comprising two arms joined by a bight at their upper ends while their lower, free ends are pivotably mounted on said web adjacent said rearmost set of wheels, said member being springloadedly urged forwardly and away from said wheels and positioned in the rearward path of movement of the main U-shaped member so as to be abuttably swingable rearwardly thereby against the spring loading, said free ends of the main U-shaped member being mounted inside said free ends of said auxiliary U-shaped member on a common shaft and lower portions of the arms of said main U-shaped member being adapted on rearward swinging of the latter to bear directly against the bight of said auxiliary U-shaped member to cause portions of said bight to bear directly and brakingly against the two wheels of the rearmost set.

5. Roller ski which comprises a web; axles mounted in parallel on said web adjacent front and rear ends of the latter; two sets of wheels mounted for rotation each on a respective one of said axles of which at least the rearmost set has two wheels, the distance between said axles being a multiple of the diameter of the wheels; a binding for the foot of the skier mounted on said web between said sets of wheels enabling the sole of the foot to be positioned approximately at the level of said axles; a main U-shaped member comprising two arms joined by a bight at their upper ends while their lower free ends are pivotably mounted on said web permitting said member, when not in use, to be swung forwards from a substantially upstanding position in the direction of motion of said ski and downwards against said web with an arm disposed on each longitudinal side of the latter and, when in use, to be swung from said substantially upstanding position in the opposite direction as a result of the pressure exerted by the leg of the skier on being moved rearwardly into abutment with said bight; and brake means comprising an auxiliary U-shaped member comprising two arms joined by a bight at their upper ends while their lower, free ends are pivotably mounted on said web adjacent said rearmost set of wheels, said member being spring-loadedly urged forwardly and away from said wheels and positioned in the rearward path of movement of the main U-shaped member so as to be abuttably swingable rearwardly thereby against the spring loading to make braking contact with said rearmost set of wheels, and said arms of said main U-shaped member when the latter is in use being resiliently and detachably connected to the bight of the auxiliary U-shaped member.

* * * * *